United States Patent [19]

Iwano et al.

[11] Patent Number: 4,699,110

[45] Date of Patent: Oct. 13, 1987

[54] FUEL SUPPLY SYSTEM

[75] Inventors: Hiroshi Iwano; Tadahiro Yamamoto, both of Yokosuka; Tadaki Ota, Fujisawa; Hiroshi Ogane; Eiichi Ohnishi, both of Yokosuka; Atsushi Yonezawa, Tokyo, all of Japan

[73] Assignee: Nissan Motor Co., Ltd., Yokohama, Japan

[21] Appl. No.: 854,411

[22] Filed: Apr. 21, 1986

[30] Foreign Application Priority Data

Apr. 26, 1985 [JP] Japan ..... 60-90683
Apr. 26, 1985 [JP] Japan ..... 60-90684
Apr. 26, 1985 [JP] Japan ..... 60-90685

[51] Int. Cl.[4] ..... F02M 51/00

[52] U.S. Cl. ..... 123/472; 123/442; 123/586; 123/587; 261/46

[58] Field of Search ..... 123/52 M, 188 M, 308, 123/432, 438, 442, 445, 446, 470, 472, 478, 531, 585, 586, 587; 261/46, 78.1, DIG. 12, DIG. 39, DIG. 42

[56] References Cited

U.S. PATENT DOCUMENTS 1,796,902 3/1931 Teeter ..... 123/585 X
1,869,122 7/1932 Vincent ..... 261/46
1,893,297 1/1933 Moore ..... 261/46
4,172,436 10/1979 Mennesson ..... 123/438
4,271,801 6/1981 Yamakawa et al. ..... 123/432
4,429,667 2/1984 Kawamura ..... 123/52 M
4,508,091 4/1985 Wakeman ..... 123/472 X
4,539,960 9/1985 Cowles ..... 123/472 X

FOREIGN PATENT DOCUMENTS 146050 1/1981 Japan .

*Primary Examiner*—Willis R. Wolfe, Jr.
*Attorney, Agent, or Firm*—Schwartz, Jeffery, Schwaab, Mack, Blumenthal & Evans

[57] ABSTRACT

A primary passage and a secondary passage in a parallel relation to each other are disposed between an air cleaner and a branch passage collecting portion of an intake manifold. The primary passage is smaller in diameter than the secondary passage and has at the downstream end thereof a laval nozzle through which air flows at the speed of sound even under low-speed low-load engine operating conditions. The laval nozzle is connected to a carburetion chamber which is elongated straightly in the direction downstream of the laval nozzle. A fuel injection valve is disposed in the primary passage at a place upstream of the laval nozzle. A pressure control valve is adapted so that a vacuum higher than a predetermined value is developed in the carburetion chamber at any time. A primary throttle valve and a secondary throttle valve are interconnected so that the secondary throttle valve is held closed unless the primary throttle valve is fully open. The primary throttle valve is movable in response to an engine operating condition.

9 Claims, 7 Drawing Figures

INDUCTION VACUUM SIGNAL
ENGINE RPM SIGNAL
FUEL
19
15
18
21
23
25
26
28
24
22
20
12
34
32
31
27
30
33
36
35
42
42A
14
9
10
8
5
7
6
4
2
1
3
1a

FUEL SUPPLY SYSTEM

BACKGROUND OF THE INVENTION

1. Field of the Invention

The present invention relates to a fuel supply system, particularly of the kind for use in a multi-cylinder internal combustion engine and adapted to supply fuel to an intake passage at a place upstream of a branch passage collecting portion.

2. Description of the Prior Art

A fuel supply system adapted to supply fuel to an intake passage at a place upstream of a branch passage collecting portion is well known in the art. A fuel supply system including a carburetor and a so-called single point injection system are of this kind.

An example of a prior art single point fuel injection system is disclosed in Japanese Provisional Patent Publication No. 56-146050 and also shown in FIG. 7. Referring to FIG. 7, designated by the reference numeral 101 is an intake pipe to be connected to a branch collecting portion of an intake manifold, by 102 a throttle valve disposed in an intake passage 103 of the intake pipe 102, and by 104 an electro-magnetic fuel injection valve. The fuel injection valve 104 is supplied with fuel of which pressure is controlled by a regulator 105 so as to be different from induction vacuum by a constant value and varies the quantity of injected fuel with variation of valve opening time. The valve opening time is controlled by a duty ratio of a pulse signal supplied from a control circuit 108 to the fuel injection valve 104. The duty ratio of the pulse signal is determined based upon an intake air quantity signal $I_1$ from an airflow meter 107 and an engine rpm signal $I_2$ from a crank angle sensor (not shown).

In general, a single point fuel injection system is encountered by a problem of an unequal distribution of fuel to engine cylinders due to the difficulty in atomization of injected fuel.

To solve this problem, the fuel injection system of FIG. 7 is provided with an additional air supply passage 110 bypassing the throttle valve 102 and reaching the place forward of a nozzle portion 104A of the fuel injection valve 104 so that based upon the pressure differential between the passage portions upstream and downstream of the throttle valve 102 high-speed air streams are introduced to the place forward of the nozzle portion 104A to collide with injected fuel to atomize the same.

However, in the fuel injection system of FIG. 7, since the quantity of additional air introduced to the place forward of the nozzle portion 104A for atomization of fuel varies depending upon the pressure differential between the passage portions upstream and downstream of the throttle valve 102, it tends to be insufficient when the opening degree of the throttle valve becomes large, making it impossible to attain good atomization of fuel and causing some injected fuel droplets to deposit on the inner wall of the intake passage to flow therealong. Unequal or uneven distribution of fuel therefore results to boost fuel consumption and exhaust emissions of hydrocarbons, carbon monoxides and oxides of nitrogens at unacceptable levels.

SUMMARY OF THE INVENTION

In accordance with the present invention, there is provided a novel and improved fuel supply system for a multi-cylinder internal combustion engine which comprises air cleaner means, intake manifold means having a plurality of branch passages and a branch passage collecting portion to which the branch passages collect, primary passage means for fluidly connecting the air cleaner means to the branch passage collecting portion, secondary passage means disposed in parallel with the primary passage means for fluidly connecting the air cleaner means to the branch passage collecting portion, the primary passage means being smaller in diameter than the secondary passage means and having at a downstream end thereof an outlet portion, carburetion chamber means interposed between the outlet portion of the primary passage means and the branch passage collecting portion for fluidly interconnecting the same, laval nozzle means formed in the outlet portion of the primary passage means, fuel injection valve means disposed in the primary passage means at a place upstream of the laval nozzle means, primary throttle valve means disosed in the primary passage means and movable in response to an engine operating condition, secondary throttle valve means disposed in the secondary passage means, linkage means for operatively interconnecting the primary throttle valve means and the secondary throttle valve means in such a manner that the secondary throttle valve means is held closed unless the primary throttle valve means is fully open, pressure control valve means disposed in the secondary passage means adjacent the secondary throttle valve means, and actuator means for actuating the pressure control valve means in such a manner that a vacuum pressure higher than a predetermined value is developed at any time at a predetermined place adjacent the laval nozzle means.

The above structure is quite effective for overcoming the above noted disadvantages and shortcomings inherent in the prior art device.

It is accordingly an object of the present invention to provide a novel and improved fuel supply system for a multi-cylinder internal combustion engine which can assuredly effect good atomization of fuel.

It is another object of the present invention to provide a novel and improved fuel supply system of the above described character which can prevent injected fuel from depositing on an intake pipe inner wall to flow therealong.

It is a further object of the present invention to provide a novel and improved fuel supply system of the above described character which can assuredly prevent unequal distribution of fuel.

It is a yet further object of the present invention to provide a novel and improved fuel supply system of the above described character which can reduce fuel consumption and lower exhaust emissions of hydrocarbons, carbon monoxides and oxides of nitrogens at acceptable levels.

BRIEF DESCRIPTION OF THE DRAWINGS

The features and advantages of the fuel supply system of the present invention will become more clearly appreciated from the following description taken in conjunction with the accompanying drawings, in which.

DETAILED DESCRIPTION OF THE PREFERRED EMBODIMENTS

Figure 1:
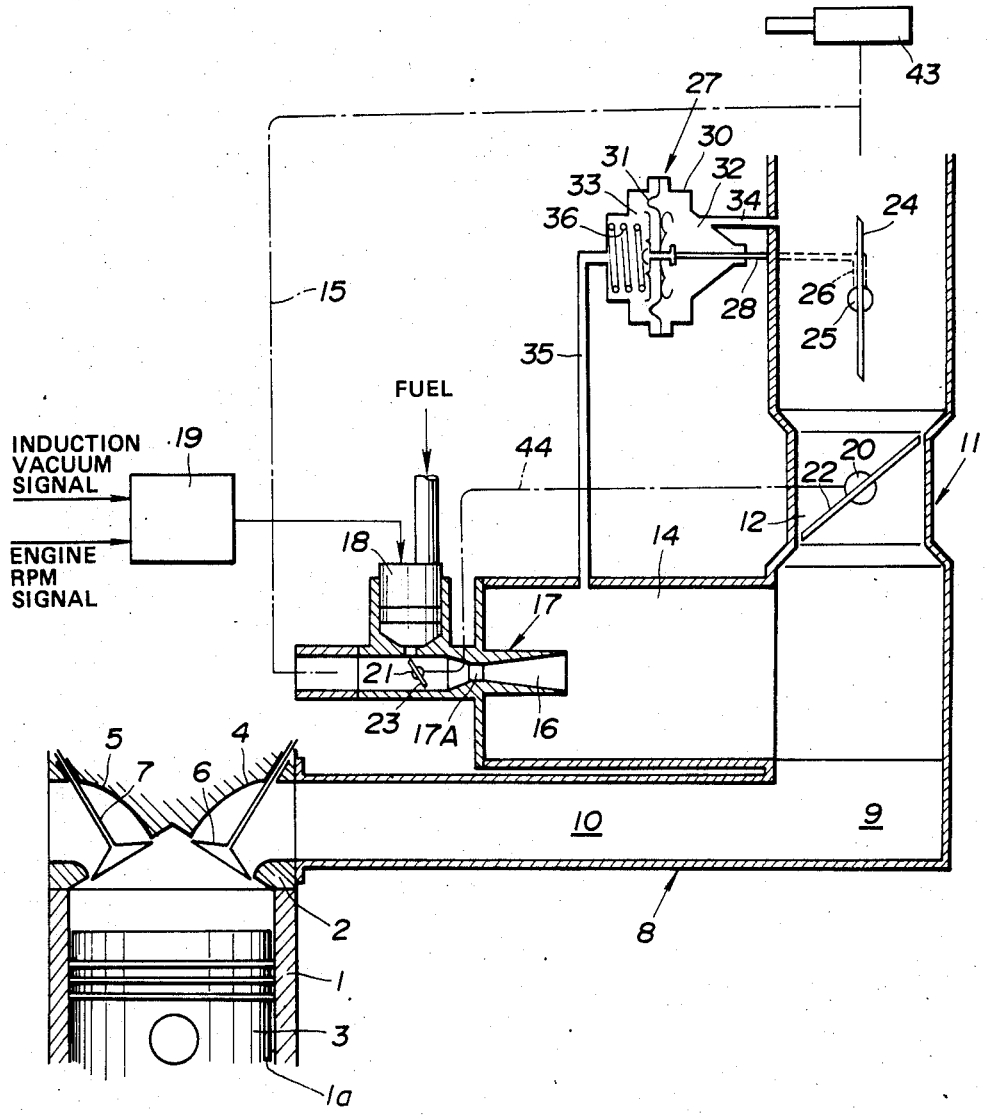
FIG. 1 is a schematic sectional view of a fuel supply system according to an embodiment of the present invention.

Referring first to FIG. 1, designated by the reference numeral 1 is a multi-cylinder internal combustion engine main body or a cylinder block having a plurality of cylinders 1*a*, a cylinder head 2, pistons 3 movable in the respective cylinders 1*a*, intake ports 4, exhaust ports 5, intake valves 6, exhaust valves 7, intake manifold branches 8 in fluid communication with the respective intake ports 4, an intake manifold branch collecting portion 9 to which the intake manifold branches 8 collect, branch passages 10 respectively formed in the intake manifold branches 8, and an intake pipe 11 or throttle body interposed between an air cleaner 43 and the intake manifold collecting portion 9.

The throttle body 11 has a secondary passage 12 in fluid communication with the intake manifold branch collecting portion 9 and has connected thereto adjacent the joint between the collection portion 9 and the throttle body 11 a tubular casing 13 in such a manner that the axis of the casing 13 intersects the axis of the throttle body 11 substantially at right angles. The inside of the tubular casing 13 is adapted to serve as a carburetion chamber 14 which is elongated straight. An outlet 16 of a primary passage 15 opens through an outward end (left-hand end in the drawing) of the tubular casing 13 into the carburetion chamber 14 in such a manner as to be coaxial with same. The primary passage 15 is so formed as to provide communication between the above described outlet 16 and a passage portion upstream of a pressure control valve 24 which will be described later or a clean side of the air cleaner 43.

Figure 7:
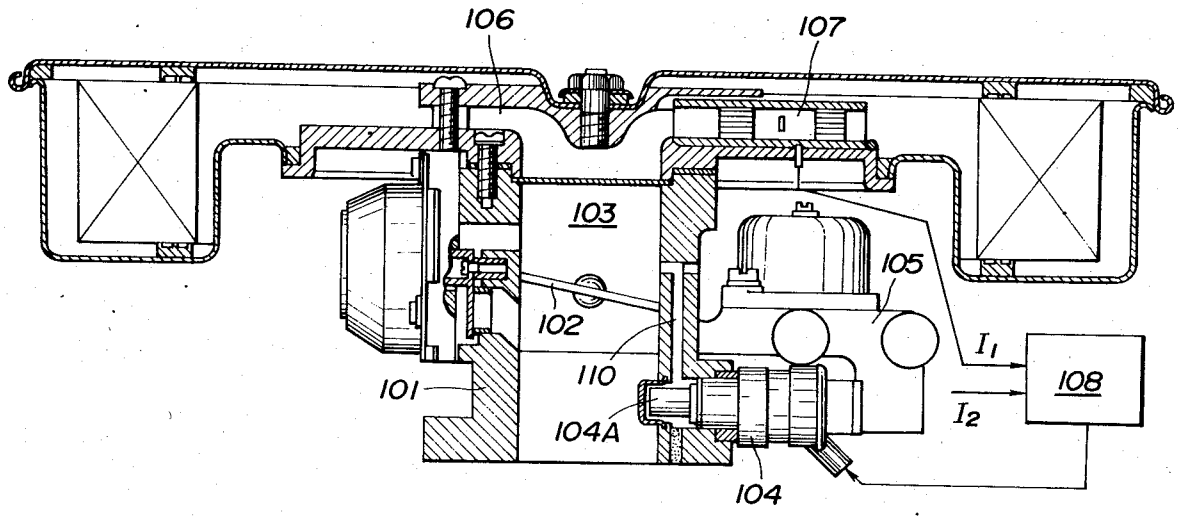
FIG. 7 (PRIOR ART)
FIG. 7 is a schematic sectional view of a prior art single point fuel injection system.

The above described outlet portion 16 of the primary passage 15 is formed with a laval nozzle 17, and there is disposed upstream of the laval nozzle 17 a fuel injection valve 18. The laval nozzle 17 and the primary passage 15 are constructed and arranged so that upon low-speed engine operating conditions the intake airflow speed at the throat portion 17A of the laval nozzle 17 reaches the speed of sound. On the other hand, the above described fuel injection valve 18 is of the same kind as that shown in FIG. 7, namely, adapted to be charged via an unshown fuel line with fuel of which pressure is controlled to be a suitable value and injects fuel into the primary passage 15 in response to a pulse signal which is supplied from a control circuit 19 and controlled thereby based upon parameters representative of engine operating conditions such as a crank angle (engine rpm), induction vacuum, etc.

The above described secondary passage 12 and primary passage 15 have rotatably disposed therein by means of valve shafts 20, 21 a secondary throttle valve 22 and a primary throttle valve 23, respectively. The primary throttle valve 22 is movable in relation to movement of an unshown accelerator mechanism so that its valve opening degree is variable in accordance with the demand of the driver, while the secondary throttle valve 22 is operatively connected by a linkage 44 to the primary throttle valve 23 so that the secondary throttle valve 22 is held closed unless the primary throttle valve 23 is fully opened. After the primary throttle valve 23 is fully open, the secondary throttle valve 22 is movable to vary its opening degree in response to variation in engine operating condition. In this connection, constructions and arrangements may otherwise be made so that as seen in some prior art two-barrel carburetors the secondary throttle valve 22 is fully opened automatically based upon the difference in intake air pressure between the two barrels after the primary throttle valve 22 is fully opened.

The secondary passage 12 has disposed therein the aforementioned pressure control valve 24 which is located upstream of the secondary throttle valve 22 and is of the same butterfly type control valve as the throttle valves 22, 23. The upstream control valve 24 is operatively connected via an arm 26 fixed to an end of its valve shaft 25 to a rod 28 of a diaphragm assembly 27 constituting means for driving the pressure control valve 24.

The diaphragm assembly 27 includes a hollow main body 30 the inside of which is divided by a diaphragm 31 having secured thereto the above described rod 28 into an atmospheric pressure chamber 32 and a vacuum chamber 33 and is adapted to introduce from an intake passage portion upstream of the pressure control valve 24 an intake air pressure substantially equal to the atmospheric pressure into the atmospheric pressure chamber 32 through a passage 34 while introducing a pressure in the carburetion chamber 14 into the vacuum chamber 33 through a passage 35. Further, within the vacuum chamber 33 there is disposed a coil spring 36 so as to urge the rod 28 outward of the body 30, namely, in the direction causing the pressure control valve 24 to close. In this connection, displacement of the diaphragm 31 and the rod 28 is determined depending upon the balance of forces acting on the diaphram 31, namely, the balance of the bias of the spring 36 and the force resulting from the differential pressure between the atmospheric pressure chamber 32 and the carburetion chamber 14, so that the more the pressure (vacuum) in the carburetion chamber reduces, the more the opening degree of the pressure control valve 24 reduces. In this instance, the spring constant and the initial load of the coil spring 36 and the pressure receiving area of the diaphram 31 are set or designed so that when the vacuum in the carburetion chamber 14 is reduced considerably in response to full opening of the secondary throttle valve 22, the opening degree of the pressure control valve 24 reduces to retain vacuum pressure of several tens of mmHg (more specifically, vacuum pressure higher than 30 mmHg) in the passage portion downstream of the secondary throttle valve 22, namely, in the carburetion chamber 14. On the other hand, while the flow sectional area of the secondary passage 12 is determined depending upon the opening degree of the secondary throttle valve 22 and the opening degree of the pressure control valve 24, the diameter of the secondary passage 12 is determined so that a sufficiently large quantity of intake air can be retained even upon high-load engine operating conditions in which the pressure control valve 24 is moved largely toward its closed position.

The fuel supply system thus far described according to an embodiment of the present invention operates as follows.

The fuel supply system is shown in FIG. 1 in an operating state into which it is put upon low-speed low-load engine operating conditions. When this is the case, a considerably high vacuum pressure is developed in the passage portion downstream of the primary throttle valve 23, and since the secondary throttle valve 22 is held in a fully closed position, intake air under those operating conditions flows substantially entirely through the primary passage 15 at high speeds and is increased in flow speed up to the speed of sound at the laval nozzle 17. On the other hand, under such low-speed low-load engine operating conditions, the absolute value of the quantity of fuel is small, and the ratio of the fuel quantity to the intake air quantity is small since the fuel supply line is so controlled as to attain an economical fuel consumption. Due to this, the quantity of fuel injected from the fuel injection valve 18 is efficiently atomized when injected into the primary passage 15 and further atomized when passing through the laval nozzle 17. Specifically, in the case where the fuel is gasoline, the average diameter of the fuel droplets is reduced to several tens of $\mu$mm.

In this manner, the atomized fuel flows at high speeds together with the intake air flow in the primary passage 15 and flows out from the outlet portion 16 into the carburetion chamber 14 and then through the intake manifold branches 8 to the respective engine cylinders 1*a*. In this connection, since the fuel in an atomized state flow longitudinally of the carburetion chamber 14, it does not deposit on the inner wall of the carburetion chamber 14 but is efficiently mixed with the intake air. Furthermore, during the time of the mixing, atomization further proceeds to reduce the diameter of the fuel droplets further. Due to this, fuel is introduced to the branch collecting portion 9 and the branch passages 10 together with intake airflow without striking against the inner wall of the throttle body 11 or the secondary passage 12 and is immediately supplied to the engine cylinders 1*a*. By this, even under low temperature conditions, good atomization of fuel can be obtained, whereby it becomes unnecessary to increase the quantity of injected fuel during cold starting and warming up and a stable engine operation under such conditions is obtained.

From this time onward, when the depression on the accelerator pedal is increased to such an extent as to cause the primary throttle valve 23 to fully open, since constructions and arrangements are made so that even under such conditions the intake air speed at the laval nozzle 17 is sufficiently large so as to be equal to the speed of sound, the average diameter of injected fuel droplets is held sufficiently small. Further, since further increase of the engine load causes the secondary throttle valve 22 to open, intake air is introduced further through the secondary passage 12 (if the pressure control valve 24 were held open, the airflow speed at the primary passage 15 would be reduced to deteriorate atomization of fuel), the pressure control valve 24 is caused to move in the direction of closing based upon the differential pressure between the carburetion chamber 14 and the atmosphere for thereby retaining a certain vacuum pressure in the carburetion chamber 14, thus making it possible to retain sonic airflow at the nozzle throat portion 17A and good atomization of fuel. Due to this, even under middle to high load engine operating conditions, deposition of fuel on the intake pipe wall and deposited fuel flow along the same can be prevented.

While in the foregoing embodiment the diaphram assembly 27 is employed as means for driving the pressure control valve 24, the driving means is not limited to this kind of actuator using fluid pressure as a power source but an electric motor such as a step motor, etc. may be employed in place therefor. Further, in a particular engine operation condition such as for example a condition in which full throttle causes engine rpm to exceed a predetermined value, generation of vacuum in the carburetion chamber 14 may be eliminated to allow the pressure control valve 24 to fully open. Further, electric heating means such as a PTC heater or other heating means using engine coolant or exhaust gases as a heat source may be provided for heating of intake air so that atomization of fuel is further improved as well as deposited fuel flow on the intake pipe wall is prevented assuredly.

Figure 2:
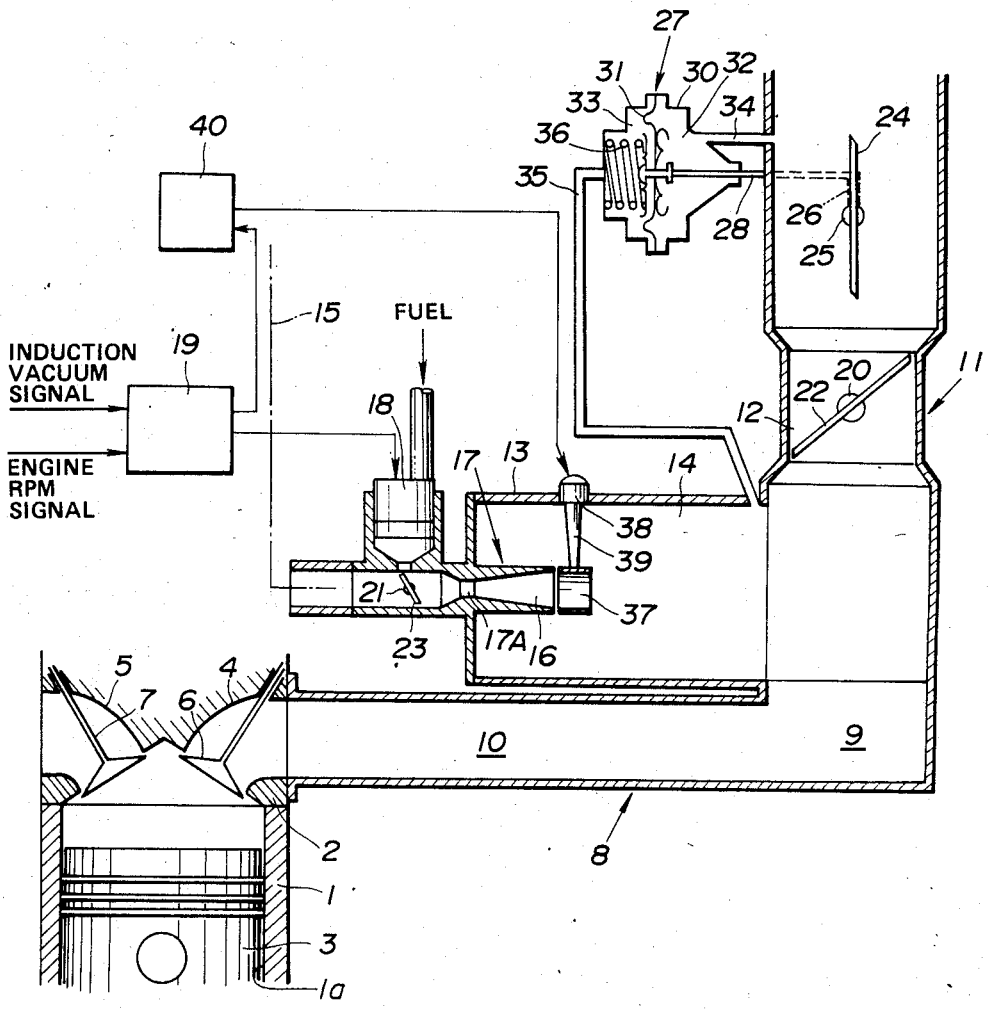
FIG. 2 is a view similar to FIG. 1 but showing a modified embodiment of the present invention.
Figure 3:
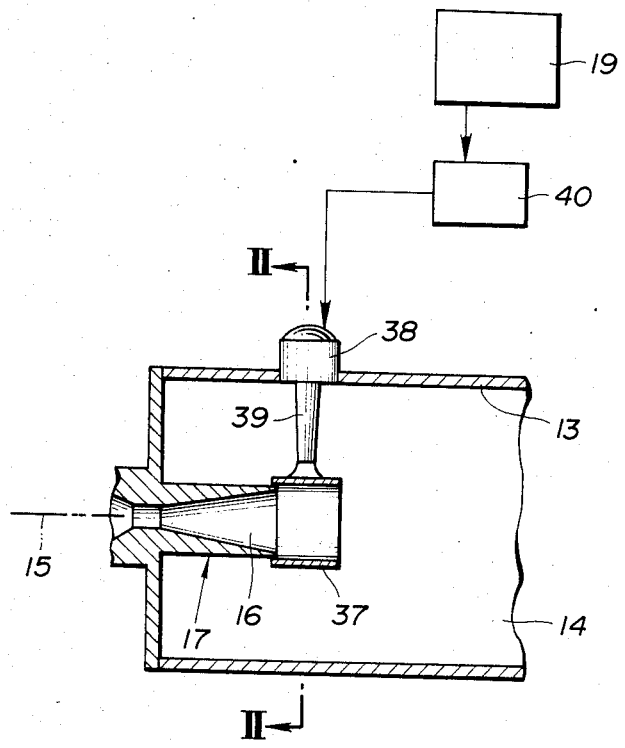
FIG. 3 is an enlarged fragmentary sectional view of an ultrasonic vibrator unit employed in the fuel supply system of FIG. 2.
Figure 4:
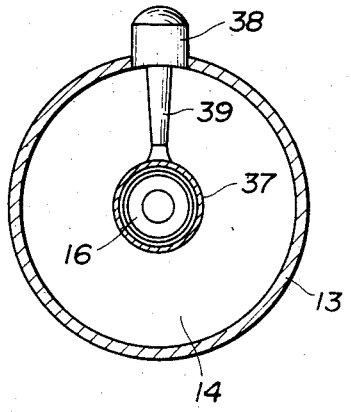
FIG. 4 is a sectional view taken along the line II—II of FIG. 3.

Referring to FIGS. 2 through 4, in which like or corresponding parts to those of the previous embodiment of FIG. 1 are designated by like reference numerals, a modified embodiment will be described.

In this embodiment, there is provided an ultrasonic vibrator 38 for subjecting the fuel flow along the inner wall of the primary passage 15 to ultrasonic vibrations for attaining further improved atomization of same. To this end, an annular vibration element 37 is disposed forward or downstream of the outlet portion 16 of the primary passage 15. The vibration element 37 is attached via a post member 39 to the ultrasonic vibrator 38 which is in turn installed on the casing 13. The post member 39 supports the vibration element 37 at a place where the vibration element 37 is so close to the terminal end of the outlet portion 16 while being out of contact with same. The ultrasonic vibrator 38 is driven by a drive circuit 40 based upon a signal from the control circuit 19 in such a manner that only upon high-load engine operating conditions in which a small quantity of fuel tends to deposit on the inner wall of the primary passage 15 to flow therealong, the vibrator 38 is put into operation. Except for the above, this embodiment is constructed and arranged substantially similar to the previous embodiment.

With the above modification, the fuel supply system operates as follows.

Under low-load engine operating conditions, the ultrasonic vibrator 38 is not put into operation since fuel scarcely deposits on the inner walls of the primary passage 15 and the laval nozzle 17 to flow therealong under these engine operating conditions.

Under high-load engine operating conditions in which the vacuum pressure in the carburetion chamber 14 is reduced as compared with that under the above described low-load engine operating conditions, some of the injected fuel, though it is a small quantity, tends to deposit on the inner wall of the primary passage 15 to flow therealong. The fuel flow along the inner wall then reaches the terminal end of the outlet portion 16 being urged by the high-speed airflow and is broken into droplets little by little to be flown downstream. In this connection, since the vibration element 37 is disposed consecutively with the outlet portion 16 of the primary passage 15, the fuel droplets are caused to flow on the inner wall of the vibrator element 37. Since under those high-load engine operating conditions the ultrasonic vibrator 38 is put into operation in response to a signal from the control circuit 19 and its vibrations are transferred via the post element 39 to the vibration element 37 to subject the same to ultrasonic vibrations, the fuel droplets are broken into fine particles at the instant when contacting the vibration element 37. Accordingly, even under these high-load engine operating conditions, good atomization of fuel can be obtained assuredly. In this connection, if almost all quantity of injected fuel were to be atomized by the ultrasonic vibrator 38, electric power consumption would become considerably large. However, since in this embodiment only a small quantity of fuel depositing on the inner wall of the primary passage 15 to flow therealong needs to be atomized (inner wall fuel flow does not occur at any other place), the electric power consumption can be small, specifically for example, only several hundreds of volts and 1 MHz of pulse are needed to be supplied to the drive circuit 40. In addition to the above, this embodiment can produce substantially the same effect as that of the previous embodiment.

Figure 5:
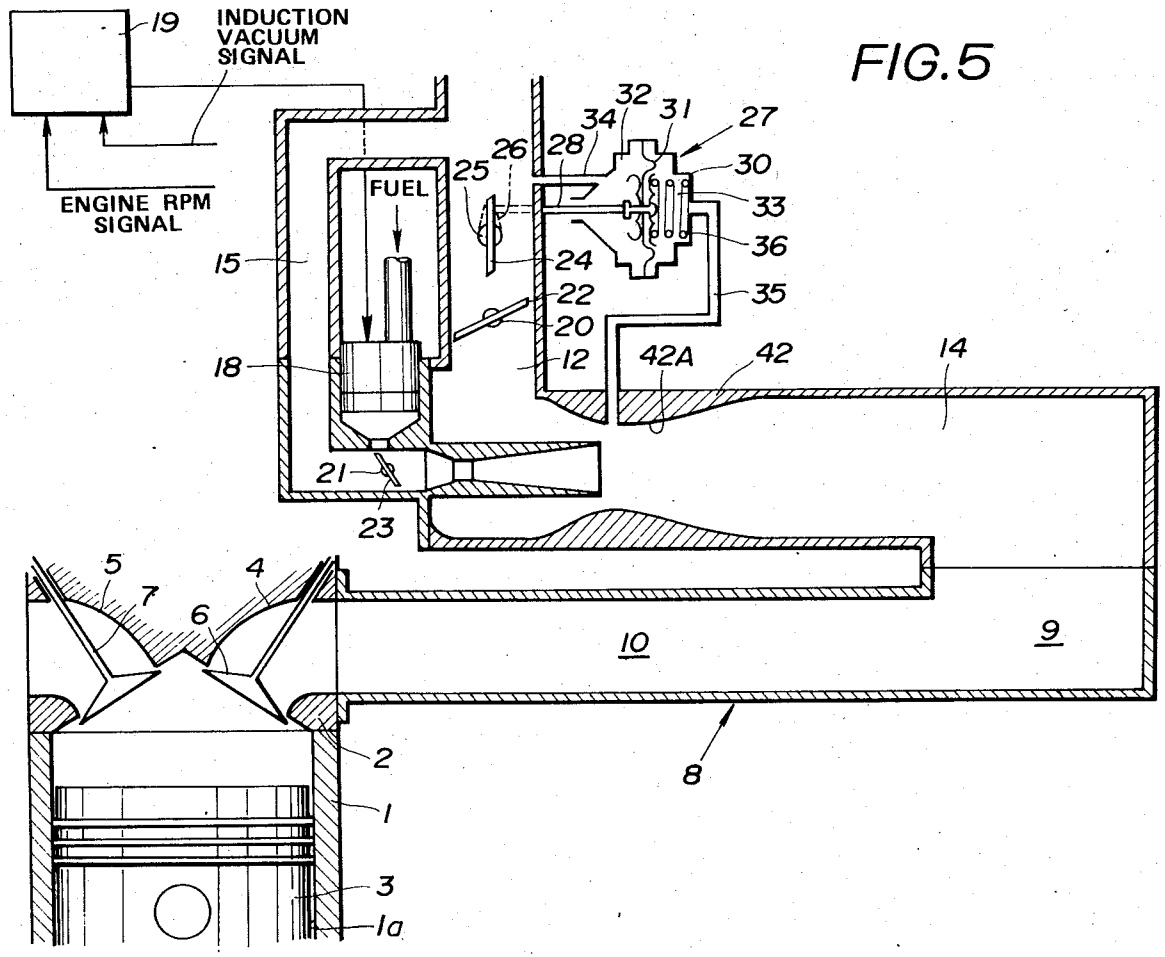
FIG. 5 is a view similar to FIG. 1 but showing another modified embodiment of the present invention.

Referring to FIG. 5, in which like or corresonding parts to those of the previous embodiment of FIG. 1 are designated by like reference numerals, another modified embodiment will be described.

In this embodiment, the secondary passage 12 is fluidly connected through the carburetion chamber 14 to the branch passage collecting portion 9 of the intake manifold 8. The carburetion chamber 14 is so arranged as to elongate in the direction intersecting the axis of the secondary passage 12 at right angles. Next to and upstream of the carburetion chamber 14 there is disposed a ventury 42. The ventury 42 is located downstream of the secondary throttle valve 22 and has a ventury throat 42A with which the outlet portion 16 of the primary passage 15 is coaxially arranged, namely, the laval nozzle 17 is arranged coaxial with the ventury throat 42A and opens downstream of the carburetion chamber 14.

The vacuum chamber 33 of the diaphram assembly 27 is communicated via the passage 35 with the ventury throat 42A so that ventury vacuum developed at the ventury throat 42A is introduced to the vacuum chamber 33.

In the modified embodiment, the ventury 13 is so constructed and arranged as to develop ventury vacuum that varies depending upon variations of engine operating conditions similarly to the vacuum pressure developed in the carburetion chamber 14 in the previous embodiment of FIG. 1. Accordingly, this embodiment can produce substantially the same effect as the previous embodiment of FIG. 1.

Figure 6:
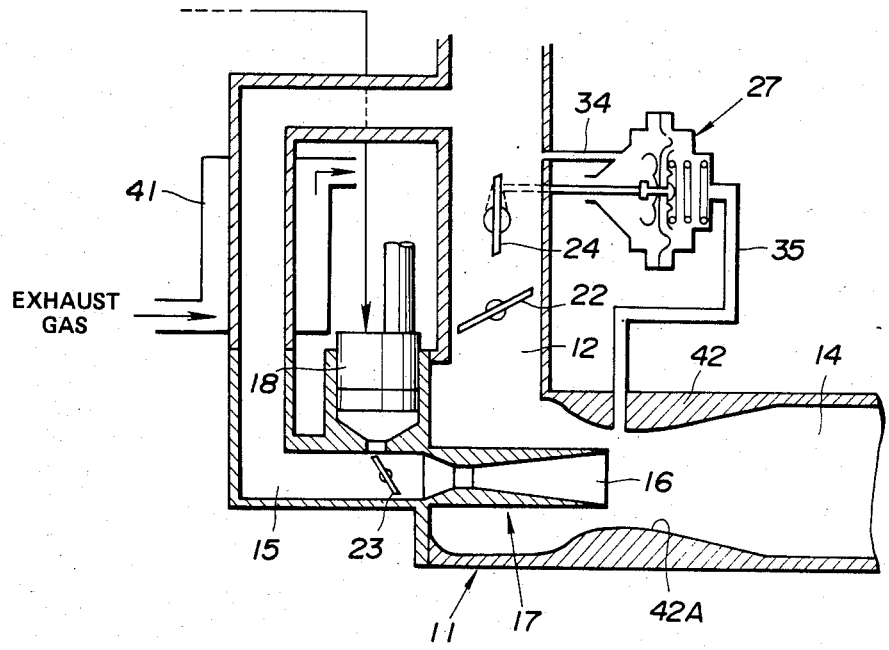
FIG. 6 is a fragmentary sectional view of a novel important portion of a further modified embodiment of the present invention.

Referring to FIG. 6, in which like or corresponding parts to those of the previous embodiment of FIG. 5 are designated by the like reference numerals, a further modified embodiment of the present invention will be described.

This embodiment is substantially similar to the previous embodiment of FIG. 5 in that a heat exchanger 41 surrounding a portion of the primary passage 15 and adapted to introduce thereinto exhaust gases is employed for heating intake air flowing through the primary passage 15 by the heat of exhaust gases to further atomize the injected fuel. In this connection, since the airflow quantity in the primary passage is relatively small and further since the heat of the heated intake air is absorbed by the injected fuel upon vaporization of same as well as by the intake air flowing through the secondary passage when mixed therewith, substantial increase in the overall temperature is not caused, thus not causing substantial reduction in the density of the air-fuel mixture and therefore the charging efficiency.

Upon high-load engine operating conditions, atomization of fuel becomes less efficient as compared with that upon low-load engine operating conditions. With the above modification, efficient atomization of fuel can be obtained even upon those high-load operating conditions. In addition to the above, this embodiment can produce substantially the same effect as the previous embodiment of FIG. 5.

What is claimed is:

1. A fuel supply system for a multi-cylinder internal combustion engine, comprising:

air cleaner means;

intake manifold means having a plurality of branch passages and a branch passage collecting portion to which said branch passages collect;

primary passage means for fluidly connecting said air cleaner means to said branch passage collecting portion;

secondary passage means disposed in parallel with said primary passage means for fluidly connecting said air cleaner means to said branch passage collecting portion;

said primary passage means being smaller in diameter than said secondary passage means and having at a downstream end thereof an outlet portion;

carburetion chamber means interposed between said outlet portion of said primary passage means and said branch passage collecting portion for fluidly interconnecting the same;

laval nozzle means formed in said outlet portion of said primary passage means;

fuel injection valve means disposed in said primary passage means at a place upstream of said laval nozzle means;

primary throttle valve means disposed in said primary passage means and movable in response to an engine operating condition;

secondary throttle valve means disposed in said secondary passage means;

linkage means operatively interconnecting said primary throttle valve means and said secondary throttle valve means in such a manner that said secondary throttle valve means is held closed unless said primary throttle valve means is fully open;

pressure control valve means disposed in said secondary passage means adjacent said secondary throttle valve means; and actuator means for actuating said pressure control valve means in such a manner that a vacuum pressure higher than a predetermined value is developed at any time at a predetermined place adjacent said laval nozzle means.

2. A fuel supply system as set forth in claim 1, in which said carburetion chamber means is elongated substantially straightly and said laval nozzle is arranged coaxially with said carburetion chamber means and opening downstream of same.

3. A fuel supply system as set forth in claim 2, in which said secondary passage means is directly connected at the downstream end thereof to said branch passage collecting portion, said carburetion chamber means being connected at the downstream end thereof to the joint of said secondary passage means and said branch passage collecting portion in such a manner as to elongate in the direction transversing the axis of said secondary passage means.

4. A fuel supply system as set forth in claim 3, in which said actuator means comprises a diaphram assembly including a hollow main body, a diaphragm dividing the inside of said hollow main body into an atmospheric pressure chamber and a vacuum chamber, a rod movable together with said diaphram and operatively connected to said pressure control valve means, a spring disposed in said vacuum chamber for urging said pressure control valve means toward its fully closed position, and a passage fluidly interconnecting said vacuum chamber and said carburetion chamber means in such a manner that the more the vacuum pressure in said carburetion chamber means reduces, the more said pressure control valve means is moved toward the fully closed position.

5. A fuel supply system as set forth in claim 2, in which said secondary passage means is connected through said carburetion chamber means to said branch passage collecting portion, said carburetion chamber means being so arranged as to elongate in the direction transversing the axis of said secondary passage means.

6. A fuel supply system as set forth in claim 5, further comprising ventury means next to and upstream of said carburetion chamber means, said ventury means having a ventury throat with which said laval nozzle means is arranged coaxially.

7. A fuel supply system as set forth in claim 6, in which said actuator means comprises a diaphram assembly including a hollow main body, a diaphram dividing the inside of said hollow main body into an atmospheric pressure chamber and a vacuum chamber, a rod movable together with said diaphram and operatively connected to said pressure control valve means, a spring disposed in said vacuum chamber for urging said pressure control valve means toward its fully closed position, and a passage fluidly interconnecting said vacuum chamber and said ventury throat in such a manner that the more the vacuum pressure at said ventury throat reduces, the more said pressure control valve means is moved toward the fully closed position.

8. A fuel supply system as set forth in claim 7, further comprising heat exchanger means for heating air flowing through said primary passage means by using heat of exhaust gases.

9. A fuel supply system as set forth in claim 1, further comprising ultrasonic vibrator means disposed downstream of said laval nozzle for atomization of fuel flowing out of said laval nozzle.

* * * * *